US011169463B2

(12) United States Patent
Ambar et al.

(10) Patent No.: US 11,169,463 B2
(45) Date of Patent: Nov. 9, 2021

(54) ADJUSTING POWER LEVELS TO COMPENSATE FOR PRINT SPOT SIZE VARIATION

(71) Applicant: HP Indigo B.V., Amstelveen (NL)

(72) Inventors: Oron Ambar, Ness Ziona (IL); Guy Nesher, Ness Ziona (IL); Haim Vladomirski, Ness Ziona (IL); Tal Frank, Ness Ziona (IL); Craig Breen, Ness Ziona (IL); Yuval Yunger, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/633,834

(22) PCT Filed: Aug. 25, 2017

(86) PCT No.: PCT/EP2017/071438
§ 371 (c)(1),
(2) Date: Jan. 24, 2020

(87) PCT Pub. No.: WO2019/037868
PCT Pub. Date: Feb. 28, 2019

(65) Prior Publication Data

US 2021/0149319 A1 May 20, 2021

(51) Int. Cl.
*G03G 15/04* (2006.01)
*G03G 15/043* (2006.01)
*G03G 15/00* (2006.01)

(52) U.S. Cl.
CPC ..... *G03G 15/04072* (2013.01); *G03G 15/043* (2013.01); *G03G 15/55* (2013.01); *G03G 2215/00029* (2013.01)

(58) Field of Classification Search
CPC ..... G03G 15/04045; G03G 15/04054; G03G 15/04063; G03G 15/04072; G03G 15/043; G03G 15/0435; G03G 15/55
See application file for complete search history.

(56) References Cited

U.S. PATENT DOCUMENTS 5,111,302 A 5/1992 Chan et al.
6,034,711 A * 3/2000 Trask ..... H04N 1/4078 347/240
6,069,645 A 5/2000 Vincent
6,618,158 B1 * 9/2003 Brown ..... B41J 29/393 358/1.13
6,982,814 B1 * 1/2006 Frazier ..... G06K 15/02 358/3.02
7,064,859 B1 6/2006 Dittrich et al.
(Continued)

OTHER PUBLICATIONS

Hadimioglu, B. et al. "Acoustic Ink Printing," IEEE 1992 Ultrasonics Symposium Proceedings, pp. 929-935< http://web.stanford.edu/group/khuri-yakub/publications/92_Hadimioglu_.

*Primary Examiner* — Carla J Therrien
(74) *Attorney, Agent, or Firm* — Michael A Dryja

(57) ABSTRACT

In an example, a method includes determining an indication of pixel separation for an image region to be printed to a substrate. A power level of a laser light source to address a pixel on a region of a photoconductive surface corresponding to the image region may be adjusted based on the indication of pixel separation to compensate for print spot size variation associated with pixel separation.

18 Claims, 5 Drawing Sheets

(56) References Cited

U.S. PATENT DOCUMENTS

| | | | | |
|---|---|---|---|---|
| 2005/0185161 | A1* | 8/2005 | Liebig | H04N 1/4015 355/53 |
| 2008/0069167 | A1 | 3/2008 | Gorton et al. | |
| 2008/0069579 | A1* | 3/2008 | Tabata | G03G 15/5029 399/53 |
| 2013/0038671 | A1* | 2/2013 | Yoshida | G03G 15/0435 347/118 |
| 2013/0278703 | A1 | 10/2013 | Hirano | |
| 2013/0287418 | A1 | 10/2013 | Akagi | |
| 2017/0090331 | A1 | 3/2017 | Kawaguchi | |
| 2017/0153588 | A1 | 6/2017 | Tanaka | |

* cited by examiner

ADJUSTING POWER LEVELS TO COMPENSATE FOR PRINT SPOT SIZE VARIATION

BACKGROUND

In printing, print agents such as inks, toners, coatings and the like may be applied to a substrate. Substrates may in principle comprise any material, for example comprising paper, card, plastics, fabrics, metals or the like.

BRIEF DESCRIPTION OF DRAWINGS

Non-limiting examples will now be described with reference to the accompanying drawings, in which.

DETAILED DESCRIPTION

Figure 1:
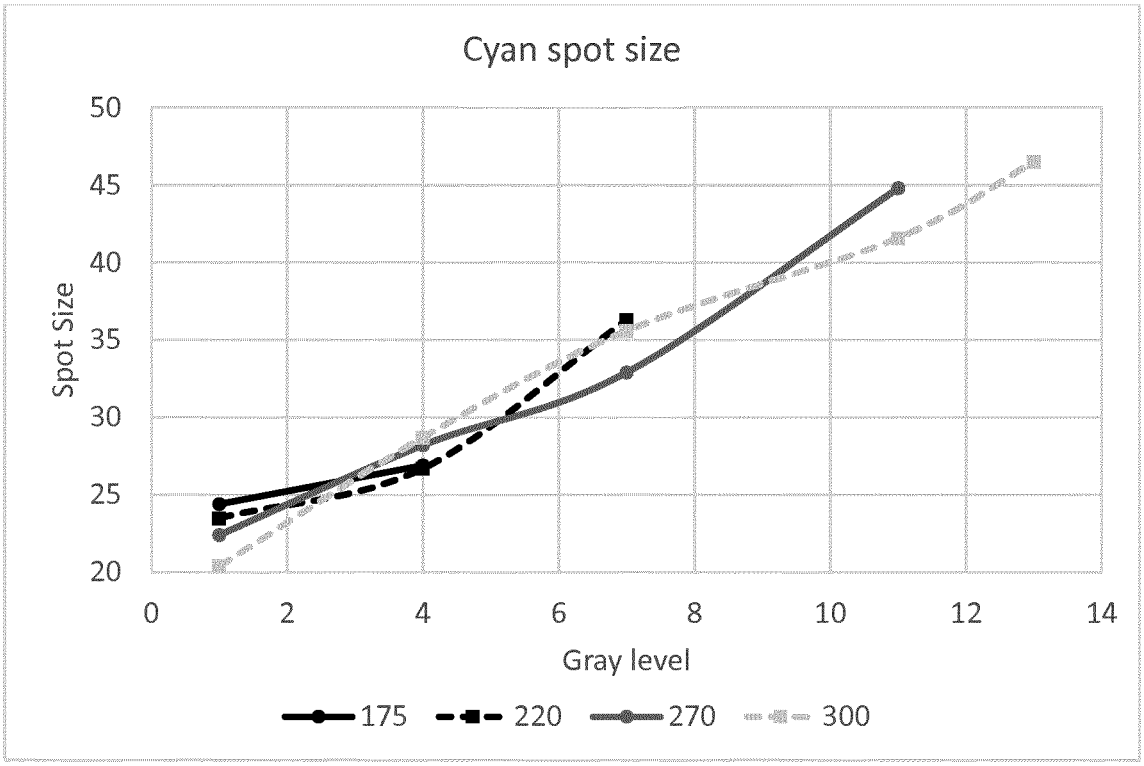
FIG. 1 shows a chart illustrating how printed spot size can vary with pixel separation for a number of print apparatus resolutions according to an example.

In some examples of printing techniques, charged print agents, such as charged toner particles or resins, may be applied to a selectively charged photoconductive surface. In some examples, such print agents are subsequently transferred (in some examples via at least one intermediate transfer member) to a substrate.

For example, a print apparatus may comprise an electrophotographic print apparatus such as a Liquid Electro Photographic (LEP) print apparatus which may be used to print a print agent such as an electrostatic printing fluid or composition (which may be more generally referred to as "an electronic ink" in some examples). Such a printing fluid may comprise electrostatically charged or chargeable particles (for example, resin or toner particles which may be colored particles) dispersed in a carrier fluid. A photo charging unit may deposit a substantially uniform static charge on a photoconductive surface (which may be termed a photo imaging plate, or 'PIP'). In some examples, such a charge is transferred to the photoconductive surface via a charge transfer roller which is in contact with the photoconductive surface, although non-contact methods of charge transfer may be used. A write head, which may for example comprise at least one laser, may be used to dissipate the static charge in selected locations of the image area on the photoconductive surface to leave a latent electrostatic image.

The electrostatic printing fluid composition (generally referred to herein as 'print agent') is transferred to the photoconductive surface from a print agent source using a print agent supply unit (which may be termed a Binary Ink Developer (BID) unit in some examples), which may present a substantially uniform film of the print agent to the photoconductive surface for example via a print agent application roller.

In an example, a resin component of the print agent may be electrically charged by virtue of an appropriate potential applied to the print agent in the print agent source. The charged resin component, by virtue of an appropriate potential on the electrostatic image areas of the photoconductive surface, is attracted to a latent electrostatic image on the photoconductive surface. The print agent does not adhere to the charged areas and forms an image in print agent on the photoconductive surface in the uncharged locations. The photoconductive surface will thereby acquire a print agent electrostatic ink composition pattern on its surface.

In some examples, the pattern may then be transferred to an Intermediate Transfer Member (ITM), by virtue of pressure and/or an appropriate potential applied between the photoconductive surface and the ITM such that the charged print agent is attracted to the ITM. The ITM may for example comprise an endless loop, which may be a rubber 'blanket', for example comprising a belt arranged about rollers or the surface of a drum. The ITM may be urged towards the photoconductive surface to be in close proximity thereto. In some examples, the ITM is biased towards the photoconductive surface such that, but for the presence of a layer of print agent on the photoconductive surface, it would be in contact with the photoconductive surface.

In some examples, the print agent pattern may be dried and/or at least partially fused on the ITM before being transferred to a substrate (for example, adhering to the colder surface thereof). In other examples, the photoconductive surface may carry a substrate, such that print agent is applied directly to the substrate from the print agent supply unit, being selectively attracted to the underlying electrostatic pattern. In other examples, print agent may be transferred from a photoconductive surface directly to a substrate.

In some examples, an image on a substrate may be built up in layers (so called 'separations') produced using different print agents.

There are many other variations of print apparatus which may comprise a photoconductive surface and the methods and apparatus set out herein may be used with, or comprise, any such apparatus.

Images printed by such apparatus may be made up of separated ink dots or spots. The separation of the spots (or their density) may be expressed in terms of grayscale or gray level.

The terms 'gray level' and 'grayscale' arose in relation to monochrome images. The darker the image or image portion in a monochrome image, the higher its gray level, and the higher the density of black dots. The terms are now used more generally to refer to all colors: for example, in an image composed of layers or separations of cyan, magenta, yellow and black colorants, each region of the image may be associated with a gray level, often between 0 and 255, for each colorant. Different image regions may have different gray levels associated therewith.

An image to be printed may be considered in terms of the color of individual pixels in a pixel grid. In general, gray levels may be achieved by at least conceptually selectively 'turning on' pixels in a cluster of pixels which form part of a pixel grid in which an image is to be built up. At low gray levels, some clusters may have a single pixel (usually a central pixel) turned on, while other clusters may have all of the pixels turned off. In the context of a photoconductive surface, 'turning on' a pixel means that a spot within a region of the photoconductive surface corresponding to the cluster is discharged using light. As the gray level increases, a point may be reached where every cluster corresponding to an image region to which the gray level applies has exactly one pixel turned on. As the gray level increases further, a second pixel may be turned on in an increasing number of clusters, and so on until a maximum gray level is reached in which all pixels are turned on in all clusters. Thus, gray level is an indication of the average pixel density in an image region.

An indication of the separation of pixels may be determined using the gray level in association the print resolution. As printer resolution increases, pixel clusters may be defined which are closer together. The clusters may have a predetermined number of pixels, which may depend on the resolution. For example, cluster centre separation may reduce from around 200 microns at relatively low resolutions to less than 100 microns as resolution increases. Moreover, from the above description, it will be appreciated that the resolution of the image produced is affected by the resolution with which the photoconductive surface is addressed using lasers or the like. As the resolution of such printers increases, the addressable 'pixels' of the photoconductive surface are correspondingly smaller.

FIG. 1 is a graph demonstrating a phenomenon. Spots of cyan colorant (in the example, an electrostatic liquid print agent) were printed at various gray levels and using various resolutions. In the tested range, gray levels relating to turning on a single pixel cluster were considered at resolutions of 175 lines per inch (LPI), 220 LPI, 270 LPI and 300 LPI. As can be seen, as the LPI increases, the number of gray levels which relate to turning on a single pixel also increases.

As can also be seen, the spot size on the page increases with gray level. At 175 LPI, the range in spot size is relatively small, being less than 10 μm between the smallest and largest spots. However, as the resolution increases, so does the difference in spot size. At 300 lines per inch, the change in spot size is around 27 μm, which is a significant change, more than doubling the size of the spot over the range. This change in spot size may result in a reduction in image quality, for example graininess being seen in the printed image.

Without wishing to be bound by theory, this may be due to electrostatic effects between the discharged single pixels, which are relatively close in higher resolution images. The interaction between nearby, but isolated, pixels may lead to a variation in spot size, which depends on the separation distance. Gray levels provide an indication of an average pixel separation over an image region. Therefore, gray levels, in conjunction with knowledge of the resolution, may be used to estimate the variation in size which may result in the absence of a correction. In another example, the separation may be determined using 'nearest neighbour' analysis, which may consider the likely change in size on a pixel by pixel basis, or based on an average pixel separation in a region which is not tied to the gray level, and which may be defined as appropriate in a given set of circumstances (for example, bearing in mind the intended image quality), or in some other way.

Figure 2:
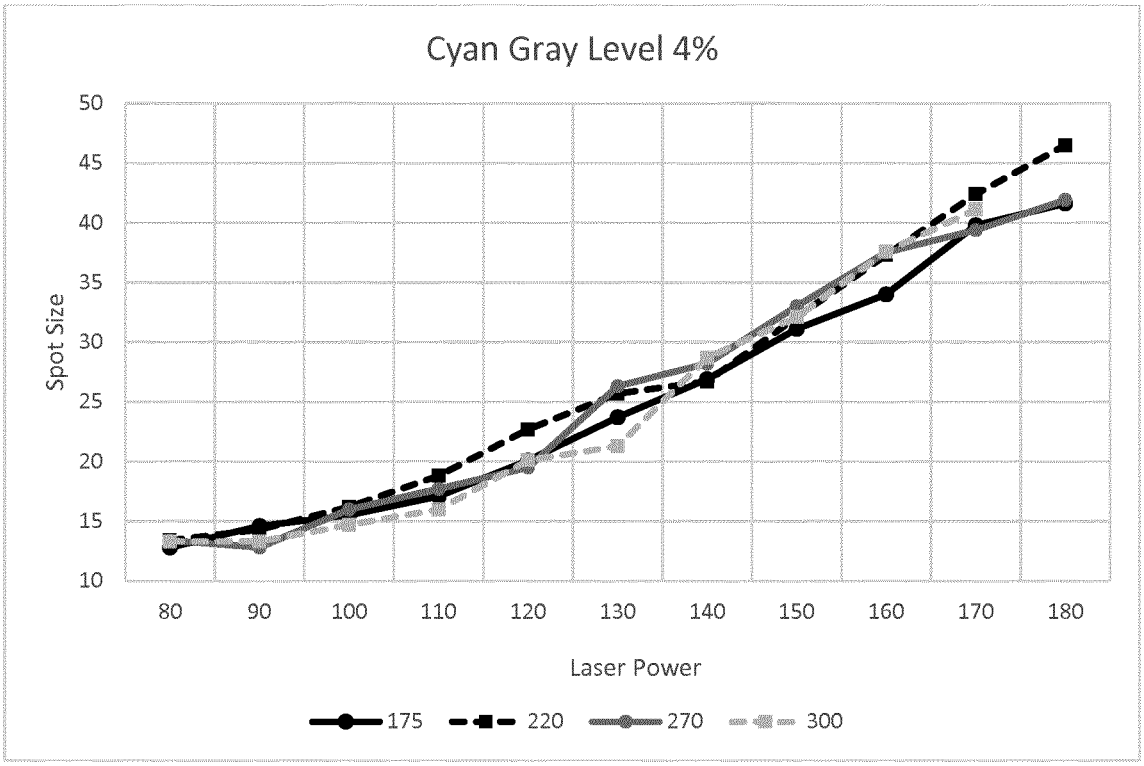
FIG. 2 shows how printed spot size can vary with laser power level for a number of print apparatus resolutions according to an example.

FIG. 2 is a graph showing cyan spots at a 4% gray level printed while laser power was varied. As can be seen, in this case, the spot size increases substantially linearly with laser power, regardless of resolution. As the gray level in this test was kept consistent at 4%, the printed spots arise from discharged regions of the photoconductive surface which are separated by substantially the same average distance. Thus it can be inferred that the spot size effect shown in FIG. 1 (in which laser power was set to a consistent value for all four resolutions tested at all gray levels) depends at least substantially on the pixel separation (in this case given by gray level) alone.

Figure 3:
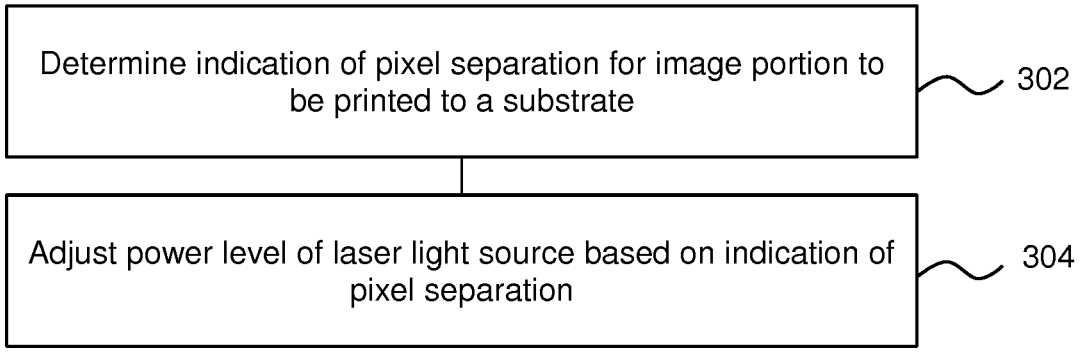
FIG. 3 is a flowchart of an example method of adjusting power levels based on pixel separation.

FIG. 3 is an example of a method, which may be a computer implemented method (for example carried out by a controller of a print apparatus) of compensating for change in printed spot size associated with pixel separation on a photoconductive surface. Block 302 comprises determining an indication of pixel separation for an image portion to be printed to a substrate. For example, this may comprise determining a gray level for an image region, which may in turn comprise obtaining digital halftone values from the input image data and averaging the digital halftone values across the image region. In some examples, a gray level for an image region is determined by obtaining a set of optical power parameters for each pixel in the image region. An optical power parameter may relate to a laser power level. Determining the gray level for an image region may comprise averaging the optical power parameters across the pixels of the image region. In other examples, determining an indication of pixel separation may comprise carrying out a nearest neighbor analysis. This may for example consider the distance of one pixel from its nearest neighbours, or may comprise an average separation over the image region (which may have any defined size and shape, for example based on the pixel grid and/or cluster size and/or separation). In other examples, the indication of pixel separation may be received from an entity (not shown), such as an image generation controller, and/or may be received as part of the input image data. In some examples, an indication of pixel separation (e.g. a gray level) for an image region is determined based on color values of pixels of the image region in the input image data. The color values may in some examples correspond to cyan, magenta, yellow (CMY) values, or to red green blue (RGB) values, or the like.

Block 304 comprises adjusting a power level of the laser light source to address a pixel on a region of a photoconductive surface corresponding to the image region based on the indication of pixel separation to compensate for print spot size variation associated with pixel separation. The compensation may be complete compensation or partial compensation, for example such that the spot size is within a range. For example, this may comprise decreasing the power level as the gray level increases. As may be recalled from, for example, FIG. 1, the spot size tends to increase with gray level at least when up to a single pixel in each cluster is addressed by a laser. As can be seen from FIG. 2, the spot size also increases with laser power.

Reducing the power of the laser tends to decrease the surface area which is discharged by the laser light. This in turn leads to a smaller spot of colorant being produced in a printed image, compensating for 'spread' in spot size associated with the pixel separation. Therefore, by carrying out the method of FIG. 3, print quality issues associated with the change in spot size due to pixel separation may be reduced or removed. For example changes in print spot size associated with pixel separation may be compensated for by a change in laser power so as to maintain a consistent print spot size (for example, limiting print spot size change to be within threshold parameters).

In one example, the spot diameter SD may be modelled based on an equation as set out below.

$$SD=A_{LP}*LP+B_{Graylevel}*GL+C$$

where LP is the laser power, GL is the gray level (which is unitless), $A_{LP}$ is a dimension which scales with laser power, $B_{Graylevel}$ is a dimension which scales with gray level, and C is a correction factor. For example, a correction factor C may vary on a laser by laser basis in order to normalise the output of all of the lasers in a laser array. In some examples, C is an average correction across a number of variables. $A_{LP}$ and C may be predetermined, for example having been measured from single spot calibration, for example measured from one or more test images in print apparatus calibration, and may vary based on the printer class (or in some cases individual printer), the laser or other optical apparatus within the printer, and the color being printed. In some examples, $A_{LP}$, $B_{Graylevel}$ and/or C may depend on the location of a pixel on the photoconductive surface. C may be zero in some examples.

Figure 4A:
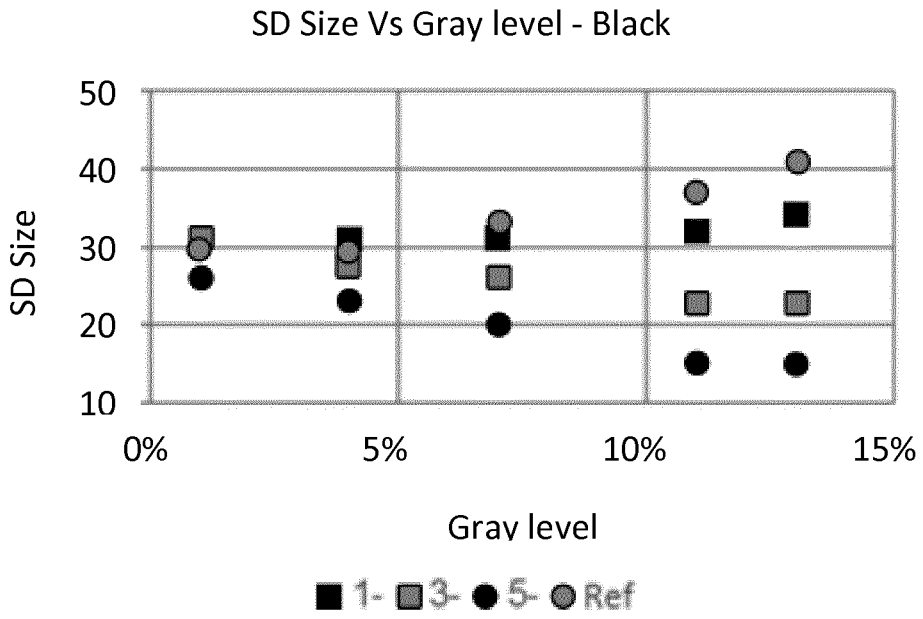
FIGS. 4A, 4B and 4C are graphs showing the effect of correction factors which may be applied to compensate for the effect of gray level on printed spot size according to an example.
Figure 4B:
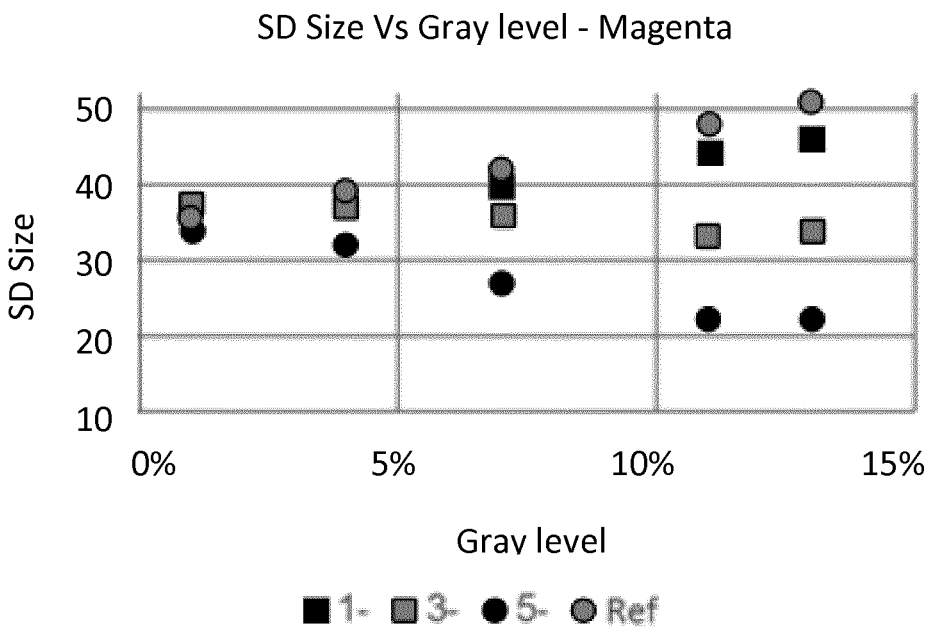
Figure 4C:
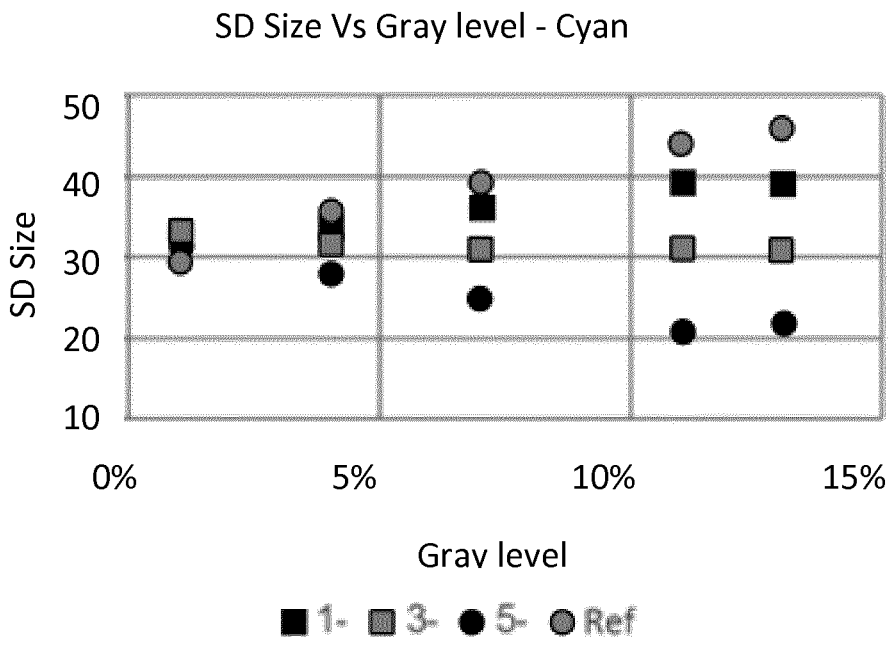

$B_{Graylevel}$ may be determined in a variety of ways. In one example, test values of the parameter may be tested, for example by printing and measuring the spot size on at least one test image. FIG. 4A-C shows examples of different $B_{Graylevel}$ values for different colors. FIG. 4A shows spot sizes for a range of gray values of black ink which are printed using test correction factors (i.e. test values of $B_{Graylevel}$) of 1, 3, 5 and 0 as a reference factor. FIGS. 4B and 4C show similar results for magenta and cyan inks respectively. As can be seen, the variance in SD size is least when $B_{Graylevel}$ is set to be 1 for the black colorant and 3 for the Magenta and Cyan colorants. Therefore, for such print apparatus, the laser power may be reduced to compensate for the value of three times the gray level for Magenta and Cyan colorants, and according to a measure of the gray level for black colorant.

Although in this example, the test values of $B_{Graylevel}$ were integers, this may not be the case. $B_{Graylevel}$ may take any value.

According to this model, in order to compensate for the contribution of the gray level to the spot size, the laser power LP can be reduced.

In practice, when forming grayscale images, not all pixels are addressed in the same way. For example, pixels on the edges of clusters may be addressed using a lower power laser than those at the centre in order to enhance image smoothness.

In some examples there may be three defined pixel power levels, ⅓, ⅔, and 1. In the examples as set out herein, a new power level, 1', may be defined. While the values, ⅓, ⅔, and 1 may be corrected by any correction value C, 1' may additionally be corrected by the grayscale term $B_{Graylevel}$*GL (noting that spreading associated with pixel separation disproportionately affects the first pixel in a cluster, which is generally a central pixel).

As has been noted above, and as a shown in FIG. 1, at lower resolutions, the difference in spot size is relatively small. Therefore, in some examples, the correction factor may be applied when the resolution is above a threshold, and not when the resolution is below the threshold. In addition, this effect appears to disproportionally affect gray levels which relates to the first pixel in each cluster. Therefore, in some examples, the correction factor may be applied when the gray level is up to a threshold at which exactly one pixel per cluster is turned on, and not when the gray level is above the threshold. In general, it may be the case that the 1$^{st}$ pixel to be 'turned on' in a cluster is a centre pixel cluster.

Figure 5:
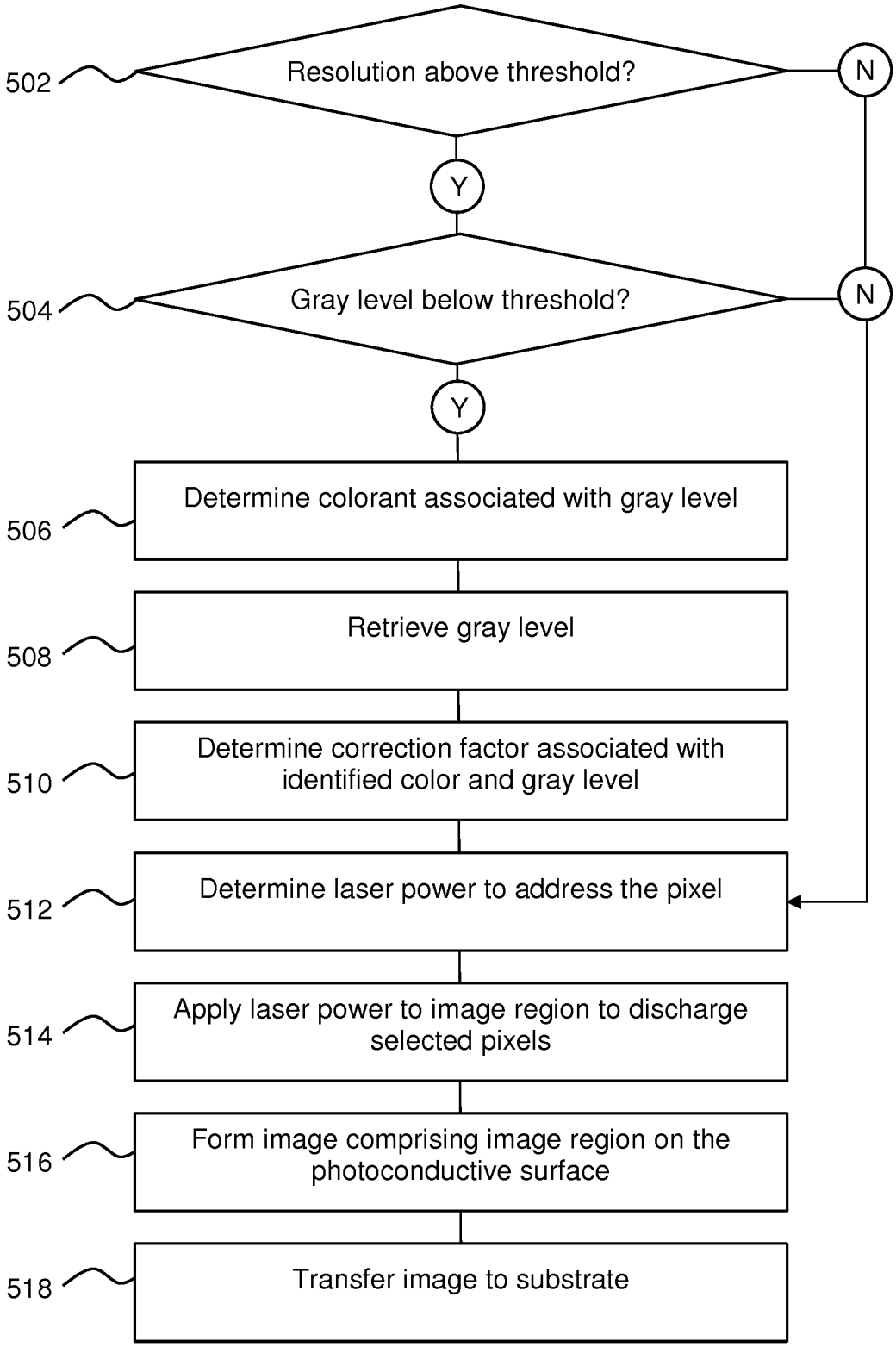
FIG. 5 is a flowchart of an example method of adjusting power levels based on gray level.

FIG. 5 is another example, which may be a method of correcting for a change in printed spot size associated with gray level in an image region.

In block 502 it is determined whether the resolution of the print apparatus is above the threshold. If so, the method proceeds to block 504; if not, the method proceeds to block 512. The threshold resolution may correspond to a cluster center separation of less than 100 μm, and in some examples less than 80 or 60 μm, or to an LPI resolution exceeding a threshold.

In block 504 it is determined whether the pixel density, which in this example is determined based on the gray level, is below a threshold. If so the method proceeds to block 506; if not the method proceeds to block 512. The threshold gray level may be the gray level at which exactly one pixel in each pixel cluster is to be 'turned on', i.e. addressed by a laser.

In some examples, a threshold gray level may be set based on the print apparatus resolution. There may be no threshold gray level for some resolutions. In some examples, the pixel density and/or separation may be determined in some other way.

In block 506, the colorant associated with the gray level is determined. In printing a number of separations to form an image, each separation may be formed in a particular color for example there may be a cyan and magenta separation. A particular pixel may have a first gray level value in the cyan separation and a second gray level value in the magenta separation. In other words, the method may be carried out on each separation separately.

In block 508, the gray level of block 502 is retrieved. In block 510 a correction factor associated with the identified color and gray level is determined (e.g. $B_{graylevel}$ as defined above).

In block 512, a laser power to address the pixel is determined.

In block 514, laser power is applied to the image region to discharge selected pixels therein. In block 516, an image comprising the image region is formed on the photoconductive surface and, in block 518, the image is transferred to a substrate.

According to this example, the correction factor is applied when certain conditions are satisfied, in particular, the resolution of the print apparatus is above the threshold and the gray level is below a threshold (although in other examples, just one or alternative conditions may be applied). This in turn may mean that the correction factor is not applied when the printed image quality is unlikely to be significantly affected by the effects of variance in the spot size due to pixel separation, and thus processing resources may be appropriately reduced.

Although the method is described in terms of image regions, in practice, the method may be carried out for a plurality of image regions such that an image is considered in its entirety. The image regions may for example be defined based on a common gray level for a particular color, or defined in some other way.

Figure 6:
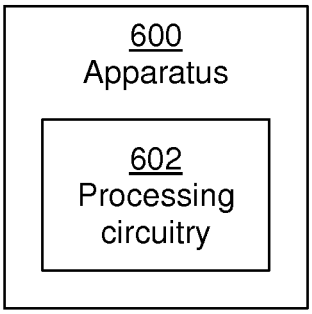
FIG. 6 is an example of an apparatus comprising processing circuitry.

FIG. 6 is an example of an apparatus 600 comprising processing circuitry 602. The processing circuitry 602 is to determine an indication of pixel separation for pixels to be addressed an image region to be printed by an electrophotographic print apparatus an image region to be printed by an electrographic print apparatus and to adjust the power level the light source of print apparatus addressing a region of a photoconductive surface on which the image region is to be formed based on the indication of pixel separation. The apparatus 600 may for example comprise a controller for an electrophotographic print apparatus. In some examples, the apparatus 600 may carry out the method of FIG. 3 or 5.

Figure 7:
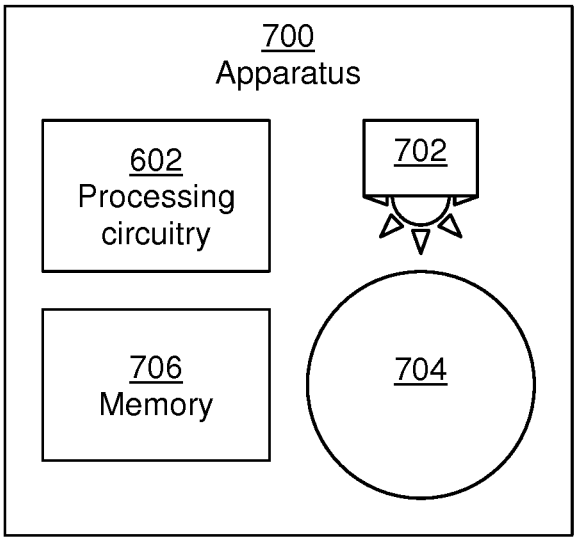
FIG. 7 is an example print apparatus.

FIG. 7 is an example of an electrophotographic print apparatus 700, in this example a liquid electrophotographic print apparatus. The apparatus 700 comprises the processing circuitry 602 of FIG. 6, which acts as a controller thereof and further comprises an array of laser light sources 702 and a photoconductive surface 704 (in this example, in the form of a drum having a PIP wrapped around the surface thereof).

The apparatus 700 also comprises a memory 706, which stores a plurality of correction factors associated with an indication of pixel separation (in this example indicated as gray levels) and colors, and which are specific to the print apparatus type. The correction factors may in practice define a correction curve having a characteristic slope and which may be associated with a cut-off gray level (e.g. the gray level for which all clusters have exactly one pixel 'turned on'). The processing circuitry 602 is to control the power of each light source the array 702 based on an intended print spot size, and a correction factor selected from the memory 706. Thus, the selected correction factor will be dependent on both the gray level and the color to be printed. In another example, the memory 706 may store a lookup table mapping between gray levels and laser power levels.

Although not shown herein, apparatus 700 may also comprise additional print apparatus components, for example print agent application unit(s), a charging unit(s) for charging the photoconductive surface, an Intermediate transfer member (ITM) which may receive an image from the photoconductive surface before transferring this image to a substrate, substrate handling apparatus, colorant curing or drying apparatus, and the like.

Figure 8:
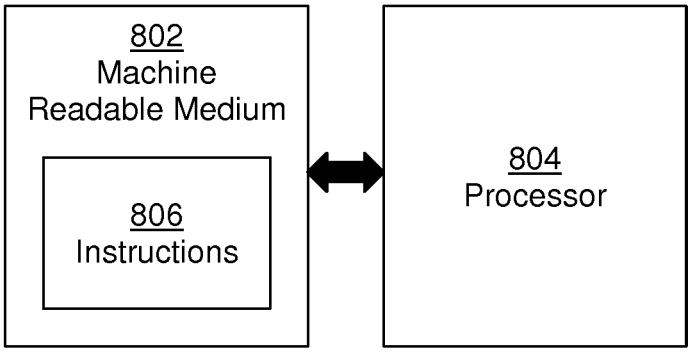
FIG. 8 is an example of a machine readable medium in association with a processor.

FIG. 8 is an example of a tangible, non-transitory, machine readable medium 802 in association with a processor 804. The tangible machine readable medium 802 comprises instructions 806 which, when executed by the processor 804, cause the processor 804 to control an electrophotographic print apparatus to reduce a light source power level with increasing gray level in an image to be printed to compensate for print spot size variation associated with pixel separation.

In some examples, the instructions 806, when executed by the processor 804, further cause the processor 804 to decrease a power level to compensate for increasing print spot size associated with an increased gray level so as to maintain a consistent print spot size across a range of gray levels. In some examples, the print spot size may vary by a threshold amount and still be sufficiently consistent. For example, the spot size may vary by around 10 to 20% of its smaller size, or by less than 10, 20 or 30 μm in diameter or according to some other threshold which may be set according to the intended print quality.

In some examples, the instructions 806, when executed by the processor 804, further cause the processor 804 to, prior to controlling the electrographic print apparatus to reduce the light source power level, determine whether the gray level is below a threshold, and to proceed if that is the case, and otherwise not perform the compensation. In some examples, the gray level threshold may be determined based on the resolution of the print apparatus for the print job. In some examples, as described above, it may also be determined if the resolution is above the threshold.

Aspects of some examples in the present disclosure can be provided as methods, systems or machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to flow charts and block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that at least one flow in the flow charts, as well as combinations of the flows in the flow charts can be realized by machine readable instructions.

The machine readable instructions may, for example, be executed by a general purpose computer, a special purpose computer, an embedded processor or processors of other programmable data processing devices to realize the functions described in the description and diagrams, and which may for example comprise at least part of the processing circuitry 602. In particular, a processor or processing apparatus may execute the machine readable instructions. Thus functional modules of the apparatus and devices may be implemented by a processor executing machine readable instructions stored in a memory (for example, the memory 706), or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims and/or other dependent claim(s).

The invention claimed is:

1. A method comprising:

determining an indication of pixel separation for an image region to be printed to a substrate, the image region is printed by turning on one or multiple pixels within a cluster of pixels corresponding to the image region in accordance with a gray level of the image region, the indication of pixel separation corresponding to a separation distance between the pixels turned on within the cluster when the image region is printed, where the separation distance increases with an increasing number of the pixels turned on within the cluster when the image region is printed; and adjusting a power level of a laser light source to address each pixel within the cluster on a photoconductive surface corresponding to the image region based on the indication of pixel separation to compensate for print spot size variation associated with pixel separation, where a print spot size of the cluster of pixels increases as the separation distance between the pixels within the cluster increases, the power level of the laser light source adjusted to reduce variation in print spot size among different clusters of pixels corresponding to different image regions to be printed.

2. A method according to claim 1 in which the indication of pixel separation is the gray level and the method comprises decreasing the power level as the gray level increases.

3. A method according to claim 1 further comprising determining a resolution of a print apparatus and carrying out the method when the resolution exceeds a threshold.

4. A method according to claim 1 further comprising determining if a pixel density is below a threshold and carrying out the method when the pixel density is below the threshold.

5. A method according to claim 1 further comprising adjusting the power level based on the indication of pixel separation and a colorant to form the image region.

6. A method according to claim 1 further comprising forming an image comprising the image region on the photoconductive surface and transferring the image to a substrate.

7. The method of claim 1, further comprising:

determining a resolution of the image region to be printed to the substrate;

determining the gray level of the image region to be printed, wherein the power level of the laser light source is adjusted responsive to determining that the resolution is greater than a resolution threshold and that the gray level is greater than a gray level threshold, and wherein the power level of the laser light source is not adjusted responsive to determining that the resolution is less than the resolution threshold or that the gray level is less than the gray level threshold.

8. The method of claim 1, wherein the power level of the laser light source is adjusted according to a model of the spot size diameter based on a sum of the power level weighted by a first constant, the gray level weighted by a second constant, and a correction factor.

9. The method of claim 8, wherein the first constant is a prespecified dimension scaling with laser power, the second constant is a determined dimension scaling with gray level, and the correction factor is a prespecified correction factor that varies on a laser-by-laser basis.

10. Apparatus comprising processing circuitry to:

determine an indication of pixel separation for pixels to be addressed in an image region to be printed by an electrophotographic print apparatus, the image region is printed by turning on one or multiple pixels within a cluster of pixels corresponding to the image region in accordance with a gray level of the image region, the indication of pixel separation corresponding to a separation distance between the pixels turned on within the cluster when the image region is printed, where the separation distance increases with an increasing number of the pixels turned on within the cluster when the image region is printed; and adjust a power level of a light source of the electrophotographic print apparatus for addressing a region of a photoconductive surface on which the image region is to be formed based on the indication of pixel separation, where a print spot size of the cluster of pixels increases as the separation distance between the pixels within the cluster increases, the power level of the light source adjusted to reduce variation in print spot size among different clusters of pixels corresponding to different image regions to be printed.

11. Apparatus according to claim 10 comprising a memory to store a plurality of correction factors associated with pixel separations, wherein the processing circuitry is to adjust the power level by applying a correction factor.

12. Apparatus according to claim 11 wherein the correction factors are additionally associated with at least one of a color to be printed and a print apparatus type.

13. Apparatus according to claim 10 further comprising electrophotographic print apparatus.

14. Apparatus according to claim 13 wherein the electrophotographic print apparatus is a liquid electrophotographic print apparatus.

15. Apparatus according to claim 13 wherein the electrophotographic print apparatus comprises a photoconductive surface and an array of laser light sources and wherein the processing circuitry is to control a power level of each light source based on an intended print spot size, the indication of pixel separation and a color to be printed.

16. A tangible machine readable medium comprising instructions which, when executed by a processor, cause the processor to:

control an electrophotographic print apparatus to reduce a light source power level with increasing gray level in an image region to be printed to compensate for print spot size variation associated with pixel separation, wherein the image region is printed by turning on one or multiple pixels within a cluster of pixels corresponding to the image region in accordance with a gray level of the image region, an indication of pixel separation corresponding to a separation distance between the pixels turned on within the cluster when the image region is printed, where the separation distance increases with an increasing number of the pixels turned on within the cluster when the image region is printed, and wherein a print spot size of the cluster of pixels increases as the separation distance between the pixels within the cluster increases, the light source power level reduced to reduce variation in print spot size among different clusters of pixels corresponding to different image regions to be printed.

17. The tangible machine readable medium of claim 16 wherein the light source power level is decreased to compensate for an increase in print spot size associated with an increased gray level so as to maintain a consistent print spot size across a range of gray levels.

18. The tangible machine readable medium of claim 16 comprising instructions which, when executed by a processor, cause the processor to, prior to controlling an electrophotographic print apparatus to reduce a light source power level with increasing gray level in an image to be printed, determine if the gray level is below a threshold.

* * * * *